US009445206B2

(12) United States Patent
Sundberg et al.

(10) Patent No.: US 9,445,206 B2
(45) Date of Patent: Sep. 13, 2016

(54) HEARING AID DEVICE HAVING BATTERY DRAWER

(71) Applicant: Oticon A/S, Smørum (DK)

(72) Inventors: Oliver Sundberg, Smørum (DK); Troels Holm Pedersen, Smørum (DK)

(73) Assignee: Oticon A/S, Smorum (DK)

( * ) Notice: Subject to any disclaimer, the term of this patent is extended or adjusted under 35 U.S.C. 154(b) by 0 days.

(21) Appl. No.: 14/679,123

(22) Filed: Apr. 6, 2015

(65) Prior Publication Data

US 2015/0289068 A1 Oct. 8, 2015

(30) Foreign Application Priority Data

Apr. 7, 2014 (EP) ..... 14163696

(51) Int. Cl.
*H04R 25/00* (2006.01)

(52) U.S. Cl.
CPC ..... *H04R 25/602* (2013.01); *H04R 25/60* (2013.01); *H04R 25/608* (2013.01); *H04R 2225/021* (2013.01); *H04R 2225/023* (2013.01); *H04R 2225/025* (2013.01); *H04R 2225/61* (2013.01); *H04R 2225/77* (2013.01)

(58) Field of Classification Search
CPC .. H04R 25/60; H04R 25/602; H04R 25/608; H04R 25/658; H04R 2225/61; H01M 2/1016; H01M 2/1022
See application file for complete search history.

(56) References Cited

U.S. PATENT DOCUMENTS 2,975,226 A * 3/1961 Lehr ..... H04R 25/602 381/323
3,138,491 A * 6/1964 Komatsu ..... H01H 29/00 200/61.58 R
3,641,288 A * 2/1972 Lamp ..... H01H 9/06 200/52 R
3,701,862 A * 10/1972 Vignini ..... H01H 19/62 200/52 R
4,941,180 A * 7/1990 Buettner ..... H04R 25/602 381/323

(Continued)

FOREIGN PATENT DOCUMENTS

CH 673743 A5 * 3/1990 ..... H04R 25/602
DE 102009004118 B3 7/2010

(Continued)

*Primary Examiner* — Curtis Kuntz
*Assistant Examiner* — Joshua Kaufman
(74) *Attorney, Agent, or Firm* — Birch, Stewart, Kolasch & Birch, LLP

(57) ABSTRACT

A hearing aid device has a housing with a battery drawer constituting a battery door that is movably mounted to the housing. The battery drawer has a finger engagement portion arranged at an outside surface of the battery drawer and a closing mechanism. The mechanism closes the battery door in response to force pushing the finger engagement portion in a first direction and keeps the battery door closed. The mechanism can also include a member that partly opens the battery door in response to force pushing the finger engagement portion in the same first direction. Moreover, a switch can be included that turns the hearing aid device on and off in response to force pushing the finger engagement portion. The closing mechanism can have a rotatably mounted member that is attached to a base extending from the member with a head that protrudes from the base.

20 Claims, 5 Drawing Sheets

(56) References Cited

U.S. PATENT DOCUMENTS 4,947,439 A * 8/1990 Buettner ..... H04R 25/602 381/323
5,204,917 A * 4/1993 Arndt ..... H04R 25/608 381/324
5,265,168 A * 11/1993 Schiess ..... H04R 25/608 381/324
5,588,064 A * 12/1996 McSwiggen ..... H04R 25/602 381/312
5,675,657 A * 10/1997 Giannetti ..... H01M 2/20 381/312
5,687,242 A * 11/1997 Iburg ..... H04R 25/602 381/312
5,995,636 A * 11/1999 Tøpholm ..... H04R 25/602 381/322
6,041,128 A * 3/2000 Narisawa ..... H04R 25/602 381/322
6,144,749 A * 11/2000 Fideler ..... H04R 25/602 381/312
6,522,764 B1 * 2/2003 Bøgeskov-Jensen .. H04R 25/60 381/322
6,658,125 B1 * 12/2003 Batting ..... H04R 25/602 381/322
6,700,983 B1 * 3/2004 Bøgeskov-Jensen et al. ..... H04R 25/60 381/322
6,808,842 B2 * 10/2004 Siddiqui ..... H01M 2/1005 429/162
7,076,075 B2 * 7/2006 Jorgensen ..... H04R 25/602 381/323
7,127,077 B2 * 10/2006 Hall ..... H04R 25/602 381/312
7,171,014 B2 * 1/2007 Morales ..... H04R 25/602 381/322
7,254,247 B2 * 8/2007 Kragelund ..... H04R 25/604 381/322
7,450,732 B2 * 11/2008 Kragelund ..... H04R 25/60 381/323
8,180,084 B2 * 5/2012 Higgins ..... H04R 25/602 381/323
8,199,951 B2 * 6/2012 Heerlein ..... H04R 25/602 381/323
8,270,646 B2 * 9/2012 Heerlein ..... H04R 25/602 381/322
8,391,525 B2 * 3/2013 Severin ..... H04R 25/554 381/322
8,556,303 B2 * 10/2013 Rajagopal ..... E05C 3/122 292/11
2003/0209413 A1 * 11/2003 Haussmann ..... H01H 21/10 200/17 R
2005/0232453 A1 * 10/2005 Fideler ..... H04R 25/604 381/322
2005/0286732 A1 * 12/2005 Linkenkaer-Hansen H04R 25/602 381/322
2007/0081684 A1 * 4/2007 Crook ..... H04R 25/602 381/322
2008/0013765 A1 * 1/2008 Nielsen ..... H04R 25/602 381/322
2008/0044049 A1 * 2/2008 Ho ..... H04R 25/602 381/323
2009/0046877 A1 * 2/2009 Lundberg ..... H03K 17/9625 381/314
2009/0110222 A1 * 4/2009 Heerlein ..... H04R 25/602 381/323
2009/0136069 A1 * 5/2009 Heerlein ..... H04R 25/602 381/323
2009/0202092 A1 * 8/2009 Ruppert ..... H01M 2/1044 381/323
2009/0252359 A1 * 10/2009 Ho ..... H04R 25/602 381/323
2010/0028763 A1 * 2/2010 Zhou ..... H04M 1/0262 429/100
2010/0098279 A1 * 4/2010 Chan ..... H04R 25/602 381/323
2010/0142736 A1 * 6/2010 Aquilina ..... H04R 25/556 381/314
2010/0172528 A1 * 7/2010 Fickweiler ..... H04R 25/602 381/323
2010/0202644 A1 * 8/2010 Angst ..... H04R 25/602 381/323
2010/0208925 A1 * 8/2010 Flaig ..... H04R 25/602 381/323
2010/0226519 A1 * 9/2010 Spragge ..... H04R 25/602 381/323
2011/0026747 A1 * 2/2011 Ochsenbein ..... H04R 25/602 381/323
2011/0033072 A1 * 2/2011 Mori ..... H04R 25/602 381/322
2011/0049174 A1 * 3/2011 Inoue ..... H01M 2/1022 220/827
2011/0188688 A1 * 8/2011 Onodera ..... H04R 25/602 381/323
2011/0194717 A1 * 8/2011 Hansen ..... H01Q 1/273 381/328
2011/0200218 A1 * 8/2011 Borregaard ..... H01M 2/1044 381/323
2011/0261984 A1 * 10/2011 Reber ..... H04R 25/602 381/323
2013/0004003 A1 * 1/2013 Tada ..... H01M 2/1044 381/323
2013/0101148 A1 * 4/2013 Karlsen ..... H04R 25/65 381/323
2013/0216077 A1 * 8/2013 Tipsmark ..... H04R 25/556 381/314
2013/0236041 A1 * 9/2013 Flaig ..... H04R 25/65 381/323
2014/0177893 A1 * 6/2014 Lu ..... H04R 25/602 381/323
2014/0334651 A1 * 11/2014 Higgins ..... H04R 25/602 381/323
2014/0354879 A1 * 12/2014 Sohn ..... H01M 2/1022 348/375
2015/0086053 A1 * 3/2015 Flaig ..... H01M 2/1038 381/323
2015/0289068 A1 * 10/2015 Sundberg ..... H04R 25/602 381/323
2015/0350797 A1 * 12/2015 Muller ..... H04R 25/602 381/323

FOREIGN PATENT DOCUMENTS

DE 102010041263 A1 3/2012
EP 0332938 A1 9/1989

* cited by examiner 2
4
6
12
14
16
18
20
24
26
28
32
34
36
40
42
44
$d_1$
$d_2$
$d_3$
h

HEARING AID DEVICE HAVING BATTERY DRAWER

TECHNICAL FIELD

The present disclosure generally relates to a hearing aid device. The present disclosure more particularly relates a hearing aid device comprising a housing having an opening and a battery drawer constituting a battery door that is rotably mounted to the housing.

PRIOR ART

U.S. Pat. No. 6,144,749 A discloses an enclosure for a battery for a hearing aid. The enclosure comprises a flexible strip connecting an enclosure door with an inside surface of case of the device. When the door is open, the strip forms a sling across the enclosure opening and the strip forms a living hinge to hold the door to the case of the device. The device is configured to receive a battery being inserted into the enclosure opening against the strip while the door is pushed into the enclosure opening. When the door is opened and the strip is pulled outward by the strip, the strip provides a force to push the battery out of the opening.

U.S. Pat. No. 5,995,636 A discloses a hearing aid with a battery compartment containing a battery and a cover pivotably coupled to a housing. The cover is adapted to close off the battery compartment. The hearing aid comprises a contact arrangement that is actuated by pressing on the cover in closed position to pivot the cover. The contact arrangement can be activated by a spring-loaded movement of the cover beyond the normal closed position.

U.S. Pat. No. 4,941,180 A discloses a hearing aid having a hinged battery compartment configured to receive a battery. The hearing aid comprises a latch notch mechanism that in conjunction with a switch, allows for a selection of the operational mode of the hearing aid. This is done by positioning the hinged battery compartment at various angles to the hearing aid housing. The battery is held firmly in the battery compartment in the various switching positions by a contact spring.

DE 102010041263 A1 discloses a housing for a hearing aid. The housing has elastically deformable sealing lip element arranged between the surfaces of detachably connectable portions of the hearing aid housing. The end portion of the sealing lip element is connected to housing portion while the other end extends over surface of a portion of the housing. The sealing lip element is undeflected in non-sealing condition and the end portion of the sealing lip element is elastically deformed in the sealing.

DE 102009004118 B3 discloses a hearing aid comprising a battery compartment that is configured to be pull when a battery has to be removed from the casing of the hearing aid. A locking element is pressed into a slot of the compartment to lock the compartment to the casing. An upper side of the element is arranged below an opening of the slot in a locking condition. The locking element stands in contact with the casing in a form-fit manner. The locking element is pressed further into the slot for unlocking such that the element is no longer in form-fit contact with the casing.

When it comes to operation of the battery door and the on/off function the prior art devices are difficult to use for most hearing aid users. This is especially the case when the hearing aid is worn by the user.

Thus, there is need for a hearing aid device that is easier and more user-friendly to apply for the user of the hearing aid device.

It is an object to provide a hearing aid device that is easier and more user-friendly to use than the prior art hearing aid devices. A further object is to provide an alternative to the prior art.

SUMMARY

The objects may be achieved by a hearing aid device as defined in claim 1. Preferred embodiments are defined in the dependent sub claims and explained in the following description and illustrated in the accompanying drawings.

In the present context, a "hearing aid device" refers to a device, such as e.g. a hearing aid, a listening device or an active ear-protection device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears.

A "hearing aid device" further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve and/or to the auditory cortex of the user.

A hearing device may be configured to be worn in any known way, e.g. as a unit arranged behind the ear with a tube leading air-borne acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. A hearing aid device may comprise a single unit or several units communicating electronically with each other.

More generally, a hearing aid device comprises an input transducer for receiving an acoustic signal from a user's surroundings and providing a corresponding input audio signal and/or a receiver for electronically receiving a input audio signal, a signal processing circuit for processing the input audio signal and an output means for providing an audible signal to the user in dependence on the processed audio signal. In a case where the input audio signal is received electronically the input audio signal has preferably been digitalised by another unit.

Some hearing aid devices may comprise multiple input transducers, e.g. for providing direction-dependent audio signal processing. In some hearing aid devices, the receiver may be a wireless receiver. In some hearing aid devices, the receiver may be e.g. an input amplifier for receiving a wired signal. In some hearing aid devices, an amplifier may constitute the signal processing circuit. In some hearing aid devices, the output means may comprise an output transducer, such as e.g. a loudspeaker for providing an air-borne acoustic signal or a vibrator for providing a structure-borne or liquid-borne acoustic signal. In some hearing aid devices, the output means may comprise one or more output electrodes for providing electric signals.

In some hearing aid devices, the vibrator may be adapted to provide a structure-borne acoustic signal transcutaneously or percutaneously to the skull bone. In some hearing aid devices, the vibrator may be implanted in the middle ear and/or in the inner ear. In some hearing aid devices, the vibrator may be adapted to provide a structure-borne acoustic signal to a middle-ear bone and/or to the cochlea. In some hearing aid devices, the vibrator may be adapted to provide a liquid-borne acoustic signal in the cochlear liquid, e.g. through the oval window. In some hearing aid devices, the output electrodes may be implanted in the cochlea or on the inside of the skull bone and may be adapted to provide the electric signals to the hair cells of the cochlea, to one or more hearing nerves and/or to the auditory cortex.

The hearing aid device according to the disclosure is a hearing aid device comprising a housing having an opening and a battery drawer constituting a battery door that is rotably mounted to the housing, which battery drawer comprises a finger engagement portion arranged at the outside surface of the battery drawer. The finger engagement portion provides a push button function to the battery drawer. The hearing aid device comprises a arrangement for closing the battery door by pushing the finger engagement portion and for maintaining the battery door closed, where the hearing aid device comprises means for at least partly opening the battery door by pushing the finger engagement portion and for maintaining the battery door at least partly open, where the hearing aid device comprises means for electrically switching the hearing aid device on and off by pushing the finger engagement portion. In an embodiment the battery drawer may include a push button for providing a push button function of the battery drawer.

Hereby it is possible to provide a hearing aid device that is easier and more user-friendly to use than the prior art hearing aid devices.

It is a huge advantage that the battery drawer functions both as battery placement and as a push on/off button. Thus, the operation of the hearing aid device is significantly simplified for the user of the hearing aid device.

The hearing aid device may be any suitable type of hearing aid e.g. a receiver-in-the-ear (RITE) hearing aid device or a behind-the-ear (BTE) hearing aid device. The hearing aid device may further be an in-the-ear (ITE) or in-the-canal (ITC) type of hearing aid. ITE and ITC hearing aids are also known as custom hearing aids. They are individually manufactured to fit a person's ear. They range from invisible in-the-canal (IIC) hearing aids to full-shell hearing aids.

The housing may have any desirable shape and size and the opening in the housing may have any suitable size and geometry. The housing may be made in any suitable material. Vents may be provided in the housing. It is possible to produce the housing by means of plastic injection moulding by way of example.

The battery drawer may constitute a battery door that is rotably mounted to the housing. The battery drawer may be shaped in any desired way and material. The battery drawer may have any desired size to hold a specifically sized-battery.

The battery drawer comprises a finger engagement portion arranged at the outside surface of the battery drawer. The finger engagement portion may have any suitable shape and size. It may be preferred that a macroscopic surface structuring is provided to the outer surface of the finger engagement portion in order to increase the friction between a finger and the finger engagement portion during operation of the push button function.

The arrangement for closing the battery door by pushing the finger engagement portion and for maintaining the battery door closed may comprise any suitable type of means e.g. mechanical engaging engagement member of corresponding geometry.

The means for at least partly opening the battery door by pushing the finger engagement portion and for maintaining the battery door at least partly open may comprise any suitable type of means e.g. mechanical means like spring members and locking members of any suitable size, geometry and type.

The means for electrically switching the hearing aid device on and off by pushing the pushing button may be any suitable type of means e.g. a mechanical coupling or decoupling means.

It may be an advantage that the finger engagement portion is configured in such a way that the hearing aid device is turned off by pushing the finger engagement portion and that the battery door is opened hereby, when operated from a closed state. The battery door may in this way be at least partly opened.

It may be beneficial that the finger engagement portion is configured in such a way that the hearing aid device is turned on by pushing the finger engagement portion and that that the battery door is closed hereby, when operated from an open state.

It may be advantageous that the opening and closing mechanism of the hearing aid device is a mechanical snap solution.

It may be advantageous that the hearing aid device comprises means for releasing the battery door from a closed state and bringing the battery door into an open state by pushing the pushing button.

Hereby the operation of the hearing aid device may be simplified and thus, the degree of user-friendliness may be increased.

It may be beneficial that the hearing aid device comprises means for bringing the battery door from an open state into a closed state by operating the push button function.

Hereby, a higher degree of user-friendliness may be achieved.

It may be advantageous that the hearing aid device comprises a rotably mounted rod-shaped pin member that is attached to a base member extending basically perpendicular to the pin member, and that a head protrudes from the base member.

The use of such pin member makes it possible to provide a simple, robust and reliable opening and closing mechanism.

It may be an advantage that the head extends basically perpendicular to the base member, such as perpendicular.

Hereby, the head may be used to engage with engagement members within the battery drawer.

It may be beneficial that the battery drawer comprises an engagement portion or engagement mechanism configured to receive the head and that an engagement member is provided in the engagement portion, where the engagement member is configured to displace the head when the finger engagement portion, or the battery drawer, is moved relative to the housing of the hearing aid device.

Hereby, it is possible to provide a simpler and reliable engagement mechanism capable of bringing the battery drawer in predefined desired positions.

It may be advantageous that the hearing aid device comprises means for switching the hearing aid device off when the battery door is brought into an open state by pushing the finger engagement portion.

These means may be any suitable electrical and/or mechanical means.

It may be beneficial that the hearing aid device comprises at least one spring that is arranged in such a manner that the spring presses against the battery drawer when the battery door is closed.

Hereby the spring may provide the required force to open the battery drawer when the battery door is closed and needs to be opened.

It is possible to replace the spring by a resilient member.

It may be advantageous that the spring is arranged in such a way that the spring is configured to push the battery drawer into a position where the battery door is at least partly open.

Hereby it is possible to provide a simple and reliable construction.

It may be beneficial that the battery drawer comprises a nail grip member provided at the distal portion of the finger engagement portion, where the nail grip member protrudes from the battery drawer.

Hereby it is possible to completely open the battery drawer in an easy way. The user-friendliness of the hearing aid device is increased.

It may be an advantage that the battery drawer comprises a body portion extending basically perpendicular to the nail grip member.

Hereby, more space is provided to place a nail during the opening of the battery door. The user of the hearing aid can open the battery drawer by placing a nail under the nail grip member and force the battery drawer to open.

It may be an advantage that the battery drawer is rotably mounted to the housing by means of one or two shafts that are attached in corresponding bore(s) within the battery drawer.

It is preferred that the hearing aid device shuts down when the battery door is open and at the same time a nail grip member appears. Hereby, it becomes easier to open the battery door.

It may be advantageous that the pin member is rotably arranged in a channel provided in the housing.

Hereby a reliable and robust mechanical construction may be achieved.

It may be beneficial that the battery drawer is provided at the end portion of the housing of the hearing aid device.

It may be advantageous that the finger engagement portion is provided with one or more, preferably two or more, transversal indentations in the outer surface of the battery door.

Hereby a better grip of the finger engagement portion may be provided. Accordingly, the push button function becomes easier to use for the user of the hearing aid device.

It may be beneficial that the housing is provided with a groove configured to receive the nail grip member of the battery drawer.

Hereby it is possible to completely receive the nail grip member in the housing of the hearing aid.

It is preferred that the geometry of the groove fits the geometry of the nail grip member of the battery drawer device so that the battery door may be sealingly closed.

It may be an advantage that the hearing aid device is configured in such a manner that when the battery door is at least partly open, the distance between the nail grip member and the top surface of the housing is at least 1 mm.

Hereby the user of the hearing aid may easily use a nail, or a device, to open the battery door.

DESCRIPTION OF THE DRAWINGS

The accompanying drawings are given by way of illustration only, and thus, they are not limitative of the present claims. The present disclosure has more details, which are discussed in relation to the drawings in which:

FIG. 1 *b*) shows a schematically close-up side view of the hearing aid device shown in FIG. 1 *a*);

FIG. 3 *b*) shows a perspective view of a pin member and base member;

FIG. 3 *c*) shows a schematically perspective view of a pin member and base member mechanically engaged within the engagement portion of a battery drawer;

DETAILED DESCRIPTION OF THE DRAWINGS

Figure 1A:
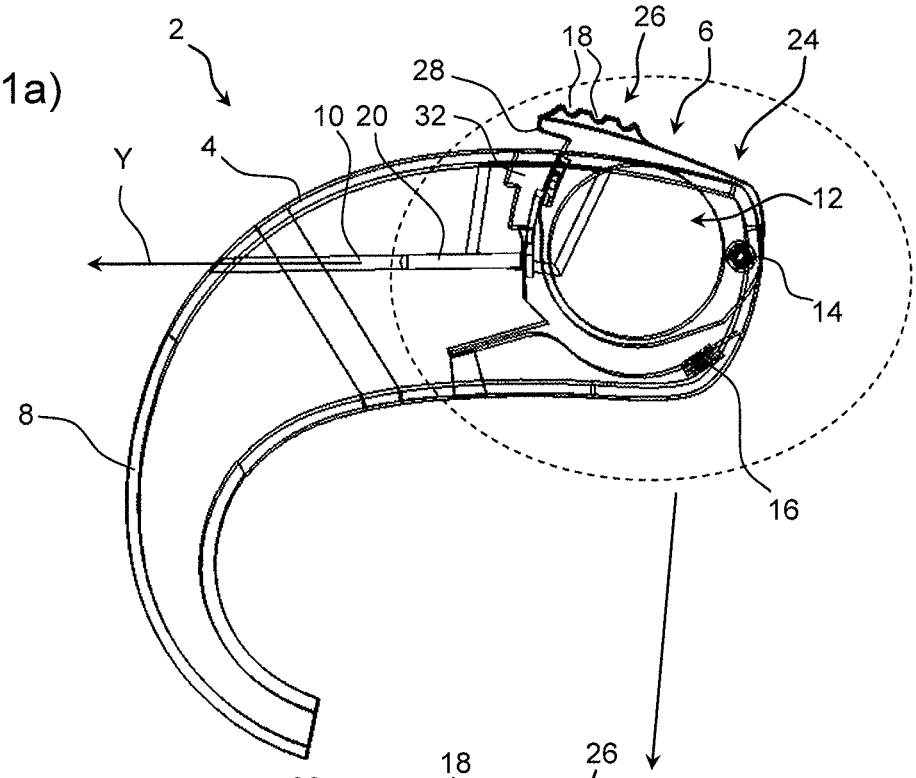
FIG. 1 *a*) shows a schematically side view of a hearing aid device.
Figure 1B:
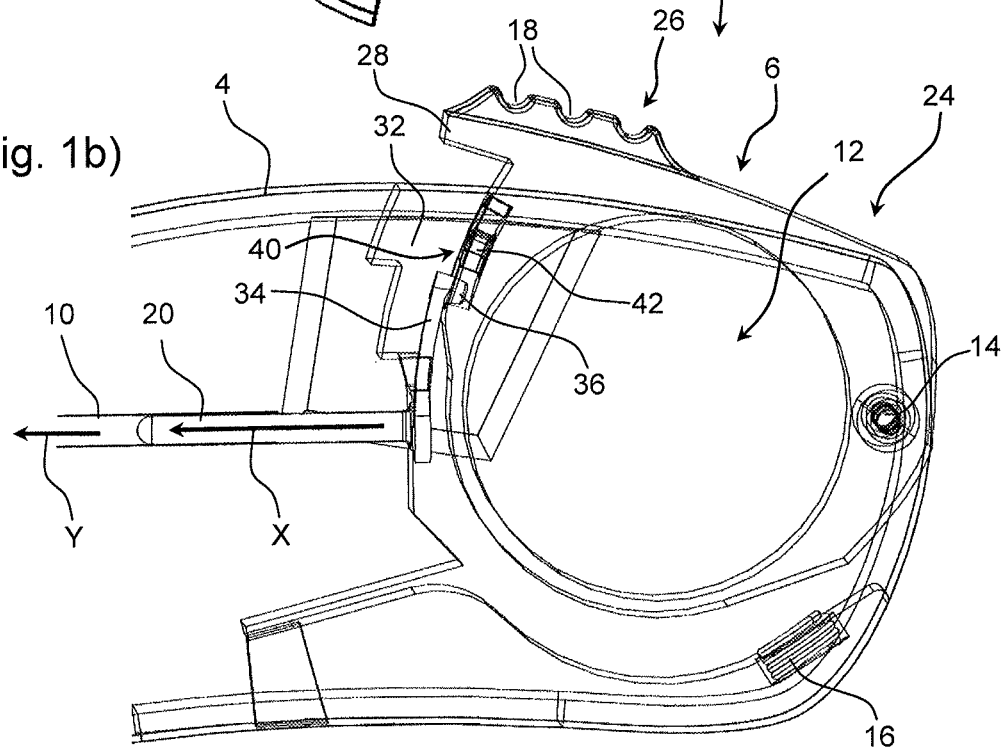

Referring now in detail to the drawings for the purpose of illustrating preferred embodiments, different views of a hearing aid device 2 is illustrated in FIG. 1.

FIG. 1 *a*) illustrates a schematically side view of a behind-the-ear (BTE) hearing aid device 2. FIG. 1 *b*) illustrates a close up side view of the hearing aid device 2 shown in FIG. 1 *a*).

The hearing aid device 2 comprises a housing 4 and a hook 8 that is attached to the distal end of the housing 4. It is important to underline that the illustration of the hearing aid device 2 is simplified for illustration purposes. Accordingly, a number of the standard elements such as the amplifier, speaker and microphone of the hearing aid device 2 are not shown in any of the drawings.

A battery drawer 24 is hinged to the housing 4. The battery drawer 24 comprises a battery compartment 12 shaped to receive and store a cylindrical battery (not shown). The battery drawer 24 comprises a battery door 6 provided with three transversal indentations 18 in its outer surface constituting a finger engagement portion 26. The indentations 18 are intended to provide an enhanced grip or traction when engaged by a finger of a user. Accordingly, the indentations 18 makes the finger engagement portion 26 easier to use for the user of the hearing aid device 2.

The battery drawer 24 has a body portion 38 that is basically flat (the surface has a slightly circular arced cross-section). The battery drawer 24 comprises a nail grip member 28 that includes the most distal portion of the finger engagement portion 26. The nail grip member 28 protrudes from the body portion 38. The user of the hearing aid may open the battery drawer 24 by placing a nail under the nail grip member 28 and forcing the battery drawer 24 to open. The battery drawer 24 is rotably mounted to the housing 4 by means of two shafts 14 that are received in corresponding bores within the battery drawer 24.

A spring 16 is fixed to the inside surface of the housing 4. The spring 16 is configured to provide a force that causes a clockwise rotation of the battery drawer 24, i.e. pivot the battery drawer 24 at the shafts 14. The force provided by the spring 16 can be used to push back the battery drawer 24, when the battery drawer 24 has to be opened (e.g. for battery replacement).

The battery drawer 24 comprises a pin member 20 that is rotably arranged in a corresponding channel 10 provided in the housing 4. The pin member 20 has a longitudinal axis X, while the channel 10 has a longitudinal axis Y that extends parallel to the longitudinal axis X of the channel 10.

Figure 3C:
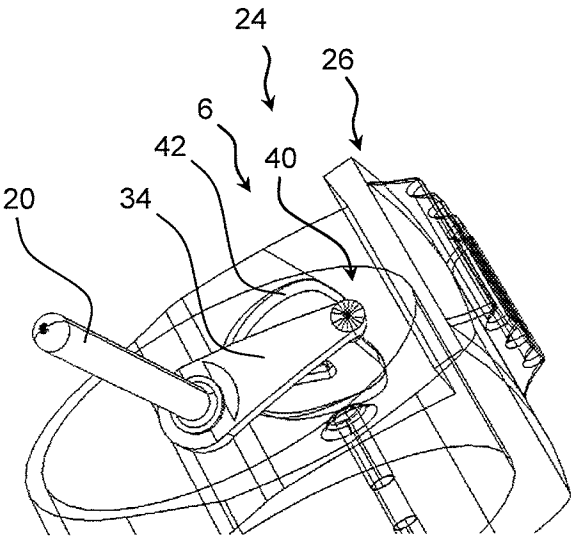
FIG. 3 *a*) shows a side view of a battery drawer of a hearing aid.
Figure 3B:
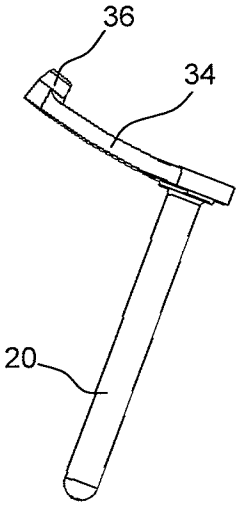
Figure 3A:
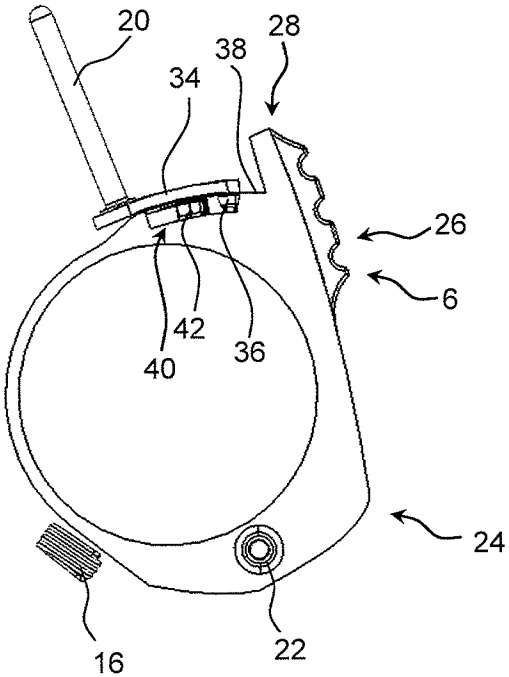

The pin member 20 is shaped as a rod that is attached to a slightly curved base member 34 that is provided with a head 36 protruding from the distal end of the basically plate-shaped base member 34 (see FIG. 3 *b* for a more detailed view).

The housing 4 has a groove 32 configured to receive the nail grip member 28 of the battery drawer 24. The geometry of the groove 32 fits the geometry of the nail grip member 28 of the battery drawer 24.

The battery drawer 24 has a built-in on/off function. A change between an "on-state" and an "off-state", respectively, is established by changing the position of the battery drawer 24 relative to the housing 4.

FIG. 2 *a*) illustrates a schematic close-up view of a hearing aid device 2. The hearing aid device 2 corresponds to the one shown in FIG. 1. In the illustrated configuration the hearing aid device 2 is in an "off-state". The top surface of the finger engagement portion 26 is in this state positioned at a distance $d_3$ above the top surface 44 of the housing 4.

In the figure it is seen that when the battery door 6 is at least partly open, the distance between the nail grip member 28 and the top surface 44 of the housing 4 is h. It may be preferred that h is at least 1 mm, so that the nail grip member 28 may be opened by using a nail.

FIG. 2 *b*) and FIG. 2 *c*) illustrates schematically close-up views of the hearing aid device 2 shown in FIG. 2 *a*). The finger engagement portion 26 has been pushed towards the central portion of the housing 4. The top surface of the finger engagement portion 26 in this state is positioned at a distance of $d_2$ above the top surface 44 of the housing 4 in FIG. 2 *b*) and in a distance $d_3$ above the top surface 44 of the housing 4 in FIG. 2 *c*). When comparing FIG. 2 *a*), FIG. 2 *b*) and FIG. 2 *c*) it can be seen, that $d_3$ is larger than $d_2$ and that $d_2$ is larger than $d_1$.

In FIG. 2 *a*) the head 36 of the base member 34 is arranged in the lowest portion of the engagement portion 40 and engages a cam surface 42. As long as the position of the finger engagement portion 26 is unchanged, the hearing aid device 2 will be maintained in the "off-state". Cam surface 42 is shaped as a cam member provided in the engagement surface by recessing a part of the surface 40.

However, in FIG. 2 *b*) the finger engagement portion 26 has been pushed down, i.e. closer to the housing, and has been arranged in an "on-state". It may be seen that the head 36 (indicated with a dotted line) of the base member 34 is in contact with cam surface 42 and positioned in the central region the engagement portion 40.

In FIG. 2 *c*) the finger engagement portion 26 has been pushed further down and into the housing 4. In this position, the spring 16 will provide a force that will force the finger engagement portion 26 to be moved upwards. In this manner it is possible to shift between the "off-state" (shown in FIG. 2 *a*) and the "on-state" (shown in FIG. 2 *b*) simply by pushing the finger engagement portion 26.

In FIG. 2 *b*) and FIG. 2 *c*) the nail gripping member 28 has been completely received by the groove 32 in the housing 4. Accordingly, the battery door 6 cannot be opened. By pushing or pressing the finger engagement portion 26 the spring 16 will push the finger engagement portion 26 back to a position corresponding to the one shown in FIG. 2 *a*).

In FIG. 2 *c*) the head 36 of the base member 34 is arranged in the uppermost portion of the engagement portion 40.

Figures 2A, 2B, 2C:
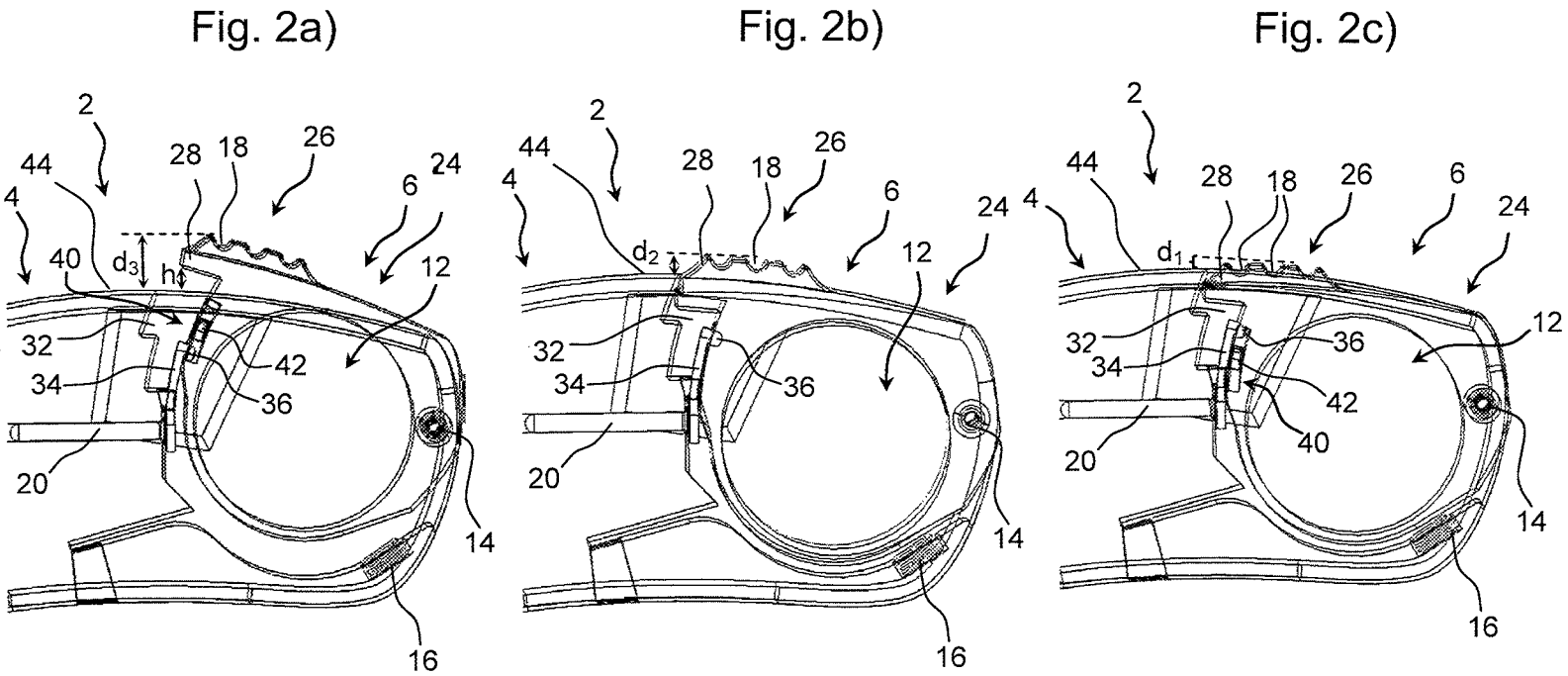
FIGS. 2*a*), 2*b*) and 2*c*) show schematically close-up side views of a hearing aid device in different states of operation.

Even though it is not shown, there may be provide any suitable type of switch (e.g. an electrical switch) configured to turn the hearing aid device 2 on or off when the finger engagement portion 26 is arranged in the configuration as illustrated in FIG. 2 *a*), FIG. 2*b*) or FIG. 2*c*).

Thus, the finger engagement portion 26 functions as on/off button. At the same finger engagement portion 26 is adapted to be used to open the battery door 6 in order to replace the battery.

When the position of the finger engagement portion 26, and thereby the battery drawer, is changed, the head 36 of the base member 34 is moved due to the mechanical engagement between the finger engagement portion 26 and the head 36. When the position of the head 36 of the base member 34 is changed, the pin member 20 rotates about its longitudinal axis X (see FIG. 1 *b*). Thus, the motion of the finger engagement portion 26 will cause rotation of the pin member 20 arranged in the channel 10 (see FIG. 1 *b*).

It is important to underline that the "on-state" and the "off-state" may be chosen differently, so that the hearing aid device 2 is turned on when the finger engagement portion 26 is arranged as illustrated in FIG. 2 *a*) and so that the hearing aid device 2 is turned off when the finger engagement portion 26 is arranged as illustrated in FIG. 2 *b*) or in FIG. 2 *c*).

The spring 16 may be made in any suitable material e.g. plastic or metal. The spring ensures that the correct and required force is applied to the battery drawer 24 during operation. In the "off-state"-position the hearing aid device 2 shuts down, and at the same time, a nail grip member 28 appears for easy opening of the battery door 6.

The head 36 of the base member 34 ensures that the battery drawer 24 can only move within a predefined range of motion. The range of motion of the head 36 defines or limits the range of motion of the battery drawer 24. Pushing the finger engagement portion 26 releases the battery drawer 24 from its position in the "on-state" and causes the battery drawer 24 to slide into the position of the "off-state".

FIG. 3 *a*) illustrates a side view of a battery drawer 24 of a hearing aid device 2. The battery drawer 24 constitutes a battery door 6 and comprises a battery compartment 12 configured to receive a cylindrical battery. The battery compartment 12 may be configured to hold a battery of the 312-type, or other types of batteries. The battery drawer 24 comprises a finger engagement portion 26 having a distal portion that constitute a nail grip member 28 protruding from a basically flat body portion 38. A bore 22 is provided in the body of the battery drawer 24. The bore 22 is intended to receive a shaft member so that the battery drawer 24 can be rotably mounted to the housing of a hearing aid device 2. The battery drawer 24 may then pivot around or at the shaft-bore interface.

Next to the battery drawer 24, a spring 16 is arranged. The spring 16 is configured to push against the battery drawer 24 to pivot or turn the battery drawer 24 in a direction away from the housing when the battery is released from the "on-state" (see FIG. 2).

An engagement portion 40 is provided in the battery drawer 24 adjacent to the body portion 28. A cam surface 42 is provided in the engagement portion 40. The mechanical engagement between the cam surface 42 and the head 36 of the base member 34 caused by movement of the finger engagement portion 26 is responsible of the motion (rotation) of the pin member 20 that takes place during operation of the finger engagement portion 26.

FIG. 3 *b*) illustrates a perspective view of a pin member 20 and base member 34. The pin member 20 and the base member 34 constitute a one-piece body. A head 36 protrudes from the base member 34. In fact, the pin member 20, the base member 34 and the head 36 constitute a one-piece body.

FIG. 3 *c*) illustrates a schematically perspective view of a pin member 20 and base member 34 that are mechanically engaged within the engagement portion 40 of a battery drawer 24. In FIG. 3 *c*) the cam surface 42 is partly visible. The head 36 of the base member 34 is positioned at the cam surface 42 so that the battery drawer would be in a closed state or position. The cam surface 42 includes two turning points, at the bends at either side of the head 36, and when the head 36 is at the opposite end of the cam surface 42, the battery drawer would be in an open state or position. In use the head 36 will travel clockwise in the cam surface 42.

The battery drawer 24 comprises a finger engagement portion 26 and when mounted in a hearing aid device 2 the battery drawer 24 constitutes a battery door 6. The pin member 20 shown in FIG. 3 *b*) is arranged in the engagement portion 40 of the battery drawer 24. It can be seen that the motion of the battery drawer 24 relative to the base member 34 will cause the movement of the base 34 and a corresponding rotation of the pin member 20.

Figure 4:
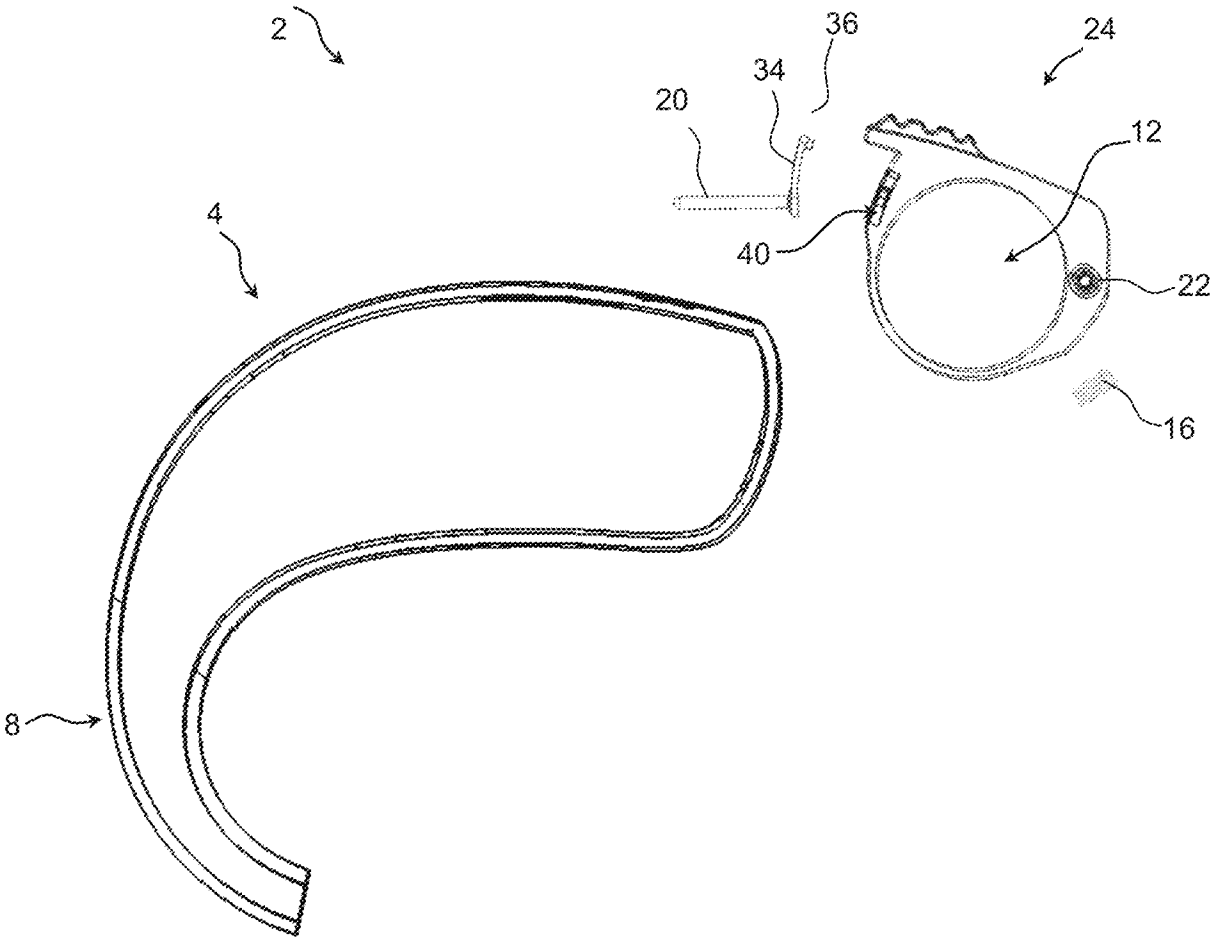
FIG. 4 shows an exploded view of a hearing aid device.

FIG. 4 illustrates an exploded view of a hearing aid device 2. The hearing aid device 2 comprises a housing 4 and a hook 8 attached to the distal portion of the housing 4.

The hearing aid device 2 moreover comprises a battery drawer 24 configured to be received by the housing 4 of the hearing aid device 2. The battery drawer 24 comprises a battery compartment 12 that is adapted to receive and contain a battery (not shown). A bore 22 is provided in the battery drawer 24. The bore 22 is intended to receive a shaft member, so that the battery drawer 24 can be rotably mounted to the housing 4 of the hearing aid device 2.

A spring 16 is arranged next to the battery drawer 24. A pin member 20 attached to the base member 34 having a head 36 protruding from the base member is arranged next to the battery drawer 24. The battery drawer 24 comprises an engagement portion 40 configured to receive the head 36 of the base member 34.

Figure 5:
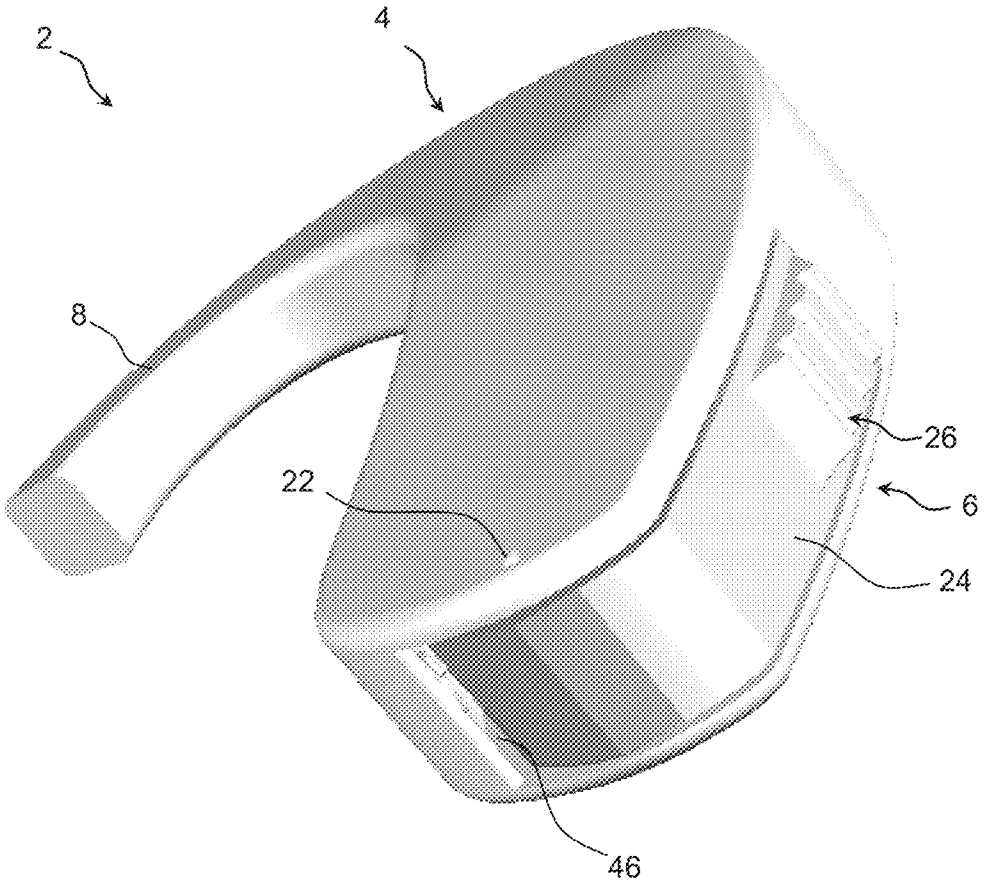
FIG. 5 shows a perspective view of a hearing aid device.

FIG. 5 illustrates a perspective view of a hearing aid device 2. The hearing aid device 2 comprises a housing 4 and a hook 8 fixed to its distal end. An opening 46 is provided in the housing 4. A battery drawer 24 is rotably mounted to the housing 4 by means of shaft members (not shown) engaging corresponding bores 22. The battery drawer 24 constitutes a battery door 6 and is provided with a finger engagement portion 26.

It is easy to open the battery door 6 using the finger engagement portion 26, e.g. in order to replace battery or simply to turn on or off the hearing aid device 2.

Although specific embodiments have been illustrated and described herein, it will be appreciated by those of ordinary skill in the art, that any arrangement which achieve the same purpose may be substituted for the specific embodiments shown. It is to be understood, that the above description is intended to be illustrative and not restrictive. Combinations of the above embodiments and many other embodiments will be apparent to those of skill in the art upon reading and understanding the above description.

In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting. Furthermore, individual features mentioned in different claims, may possibly be advantageously combined, and the mentioning of these features in different claims does not exclude that a combination of features is not possible and advantageous.

The present disclosure highlight the following items:

A hearing aid device (2) according to an embodiment may include a housing (4) having an opening (46) and a battery drawer (24) constituting a battery door (6) that is movably mounted to the housing (4), which battery drawer (24) may include a finger engagement portion (26) arranged at the outside surface of the battery drawer (24). In an embodiment, the hearing aid device (2) may include a mechanism (20, 34, 36, 40, 42) for closing the battery door (6) by pushing the finger engagement portion (26) and for maintaining the battery door (6) closed, where the hearing aid device (2) may also include a mechanism (20, 34, 36, 40, 42) for at least partly opening the battery door (6) by pushing the finger engagement portion (2) and for maintaining the battery door (6) at least partly open, and the hearing aid device (2) may also include a switch (20, 34, 36, 40, 42) for electrically switching the hearing aid device (2) on and off by pushing the pushing button (2).

In an embodiment, the hearing aid device (2) may also include a release device (26, 20, 34, 36, 40, 42) for releasing the battery door (6) from a closed state and bringing the battery door (6) into an open state by pushing the pushing button (2).

In an embodiment, the hearing aid device (2) may further include a device (26, 20, 34, 36, 40, 42) for bringing the battery door (6) from an open state into a closed state by pushing the pushing button (2).

In an embodiment, the hearing aid device (2) further may include a rotatably mounted rod-shaped pin member (20) that is attached to a base member (34) extending basically perpendicular to the pin member (20), and that a head (36) protrudes from the base member (34).

In an embodiment, the battery drawer (24) may include an engagement portion (40) configured to receive the head (36) and that a cam surface (42) is provided in the engagement portion (40), where the cam surface (42) is configured to displace the head (36) when the finger engagement portion is moved relative to the housing (4) of the hearing aid device (2).

In an embodiment, the hearing aid device (2) further may include a switch for switching the hearing aid device (2) off when the battery door (6) is brought into an open state by pushing the pushing button (2).

In an embodiment, the hearing aid device (2) according to one of the preceding items, wherein the hearing aid device (2) comprises at least one spring (16) that is arranged in such a manner that the spring (16) presses against the battery drawer (24) when the battery door (6) is closed.

In an embodiment, the spring (16) is arranged in such a way that the spring (16) is configured to push the battery drawer (24) into a position where the battery door (6) is at least partly open.

In an embodiment, the battery drawer (24) may include a nail grip member (28) provided at the distal portion of the finger engagement portion (26), where the nail grip member (28) protrudes from the remaining part of the battery drawer (24).

In an embodiment, the battery drawer (24) may include a body portion (38) extending basically perpendicular to the nail grip member (28).

In an embodiment, the pin member (20) can be rotatably arranged in a channel (10) provided in the housing (4).

In an embodiment, the battery drawer (26) is provided at the end portion of the housing (4) of the hearing aid device (2).

In an embodiment, the battery door (6) is provided with one or more, preferably two or more transversal indentations (18) in the outer surface of the battery door (6).

In an embodiment, the housing (4) is provided with a groove (32) configured to receive the nail grip member (28) of the battery drawer (24).

In an embodiment, when the battery door (6) is at least partly open the distance (h) between the nail grip member (28) and the top surface (44) of the housing (4) is at least 1 mm.

LIST OF REFERENCE NUMERALS

2—Hearing aid device
4—Housing
6—Battery door
8—Hook
10—Channel
12—Battery compartment
14—Shaft
16—Spring
18—Indentation
20—Pin member
22—Bore
24—Battery drawer
26—Finger engagement portion
28—Nail grip member
30—Engagement member
32—Groove
34—Base member
36—Head
38—Body portion
40—Engagement portion
42—Cam surface
44—Top surface
46—Opening
$d_1$, $d_2$, $d_3$—Distance
X, Y—Longitudinal axis

The invention claimed is:

1. A hearing aid device, comprising:

a housing having an opening and a battery drawer constituting a battery door that is movably mounted to the housing, which battery drawer comprises a finger engagement portion arranged at an outside surface of the battery drawer, the finger engagement portion providing a push button function to the battery drawer;

a closing mechanism configured to close the battery door in response to force pushing the finger engagement portion in a first direction and configured to maintain the battery door closed;

a member for at least partly opening the battery door in response to force pushing the finger engagement portion in said first direction and for maintaining the battery door at least partly open; and a switch element for electrically switching the hearing aid device on and off in response to force pushing the push button, wherein the closing mechanism comprises a rotatably mounted member that is attached to a base member extending from the member, and a head protrudes from the base member.

2. The hearing aid device according to claim 1, wherein the hearing aid device comprises a release mechanism for releasing the battery door from a closed state and bringing the battery door into an open state by pushing the finger engagement portion.

3. The hearing aid device according to claim 2, wherein the hearing aid device comprises means for bringing the battery door from an open state into a closed state by pushing the finger engagement portion.

4. The hearing aid device according to claim 1, wherein the hearing aid device comprises means for bringing the battery door from an open state into a closed state by pushing the finger engagement portion.

5. The hearing aid device according to claim 1, wherein the rotatably mounted member is a rod-shaped pin that is attached to the base member extending basically perpendicular to the pin member.

6. The hearing aid device according to claim 5, wherein the battery drawer comprises an engagement portion configured to receive the head and a cam surface is provided in the engagement portion, where the cam surface is configured to displace the head when the finger engagement portion is moved relative to the housing of the hearing aid device.

7. The hearing aid device according to claim 5, wherein the hearing aid device comprises means for switching the hearing aid device off when the battery door is brought into an open state by pushing the finger engagement portion.

8. The hearing aid device according to claim 5, wherein the pin is rotatably arranged in a channel provided in the housing.

9. The hearing aid device according to claim 1, wherein the hearing aid device comprises at least one spring that is arranged in such a manner that the spring presses against the battery drawer when the battery door is closed.

10. The hearing aid device according to claim 9, wherein the spring is arranged in such a way that the spring is configured to push the battery drawer into a position where the battery door is at least partly open.

11. The hearing aid device according to claim 1, wherein the battery drawer comprises a nail grip member provided at the distal portion of the finger engagement portion, where the nail grip member protrudes from the remaining part of the battery drawer.

12. The hearing aid device according to claim 11, wherein the battery drawer comprises body portion extending basically perpendicular to the nail grip member.

13. The hearing aid device according to claim 11, wherein the housing is provided with a groove configured to receive the nail grip member of the battery drawer.

14. The hearing aid device according to claim 11, wherein the hearing aid device is configured in such a manner that when the battery door is at least partly open the distance between the nail grip member and the top surface of the housing is at least 1 mm.

15. The hearing aid device according to claim 1, wherein the battery drawer is provided at the end portion of the housing of the hearing aid device.

16. The hearing aid device according to claim 1, wherein the battery door is provided with one, two, or more transverse indentations in the outer surface of the battery door.

17. A hearing aid device, comprising:

a housing having an opening and a battery drawer constituting a battery door that is movably mounted to the housing, the battery drawer including a finger engagement portion arranged at an outside surface of the battery drawer, the hearing aid device further comprising means for closing the battery door in response to force pushing the finger engagement portion in a first direction and for maintaining the battery door closed, where the hearing aid device comprises means for at least partly opening the battery door in response to force pushing the finger engagement portion in the first direction and for maintaining the battery door at least partly open, where the hearing aid device comprises means for electrically switching the hearing aid device on and off by pushing the finger engagement portion.

18. The hearing aid device according to claim 17, wherein the hearing aid device comprises a rotatably mounted rod-shaped pin member that is attached to a base member extending basically perpendicular to the pin member, and a head protrudes from the base member.

19. The hearing aid device according to claim 17, wherein the battery drawer comprises an engagement portion configured to receive the head, and a cam surface is provided in the engagement portion, where the cam surface is configured to displace the head when the finger engagement portion is moved relative to the housing of the hearing aid device.

20. The hearing aid device according to claim 17, wherein the hearing aid device comprises means for switching the hearing aid device off when the battery door is brought into an open state by pushing the finger engagement portion.

* * * * *